US005697598A

United States Patent [19]

Fabiano et al.

[11] Patent Number: 5,697,598

[45] Date of Patent: Dec. 16, 1997

[54] ONE PIECE LOAD REST

[75] Inventors: Antonio Fabiano, Newmarket; Andrew David Millman, Orillia, both of Canada

[73] Assignee: Ventra Group Inc., Canada

[21] Appl. No.: 551,751

[22] Filed: Nov. 7, 1995

[51] Int. Cl.[6] ..... B66F 3/12

[52] U.S. Cl. ..... 254/126

[58] Field of Search ..... 254/122, 126, 254/1, DIG. 3, 8 B; 29/267

[56] References Cited

U.S. PATENT DOCUMENTS

| | | | |
|---|---|---|---|
| 1,534,992 | 4/1925 | Reeves . | |
| 1,701,314 | 2/1929 | Shook . | |
| 4,194,725 | 3/1980 | Erschens . | |
| 4,848,733 | 7/1989 | Yamauchi . | |
| 5,135,201 | 8/1992 | Engel . | |
| 5,199,688 | 4/1993 | Engel | 254/126 |

FOREIGN PATENT DOCUMENTS

| | | |
|---|---|---|
| 2 671 065 | 7/1992 | France . |
| 2 936 002 | 3/1981 | Germany . |
| 3 033 956 | 6/1982 | Germany . |
| 1 551 256 | 8/1979 | United Kingdom . |
| 2 145 392 | 3/1985 | United Kingdom . |

*Primary Examiner*—Robert C. Watson

*Attorney, Agent, or Firm*—Cushman Darby & Cushman Intellectual Property Group of Pillsbury Madison & Sutro, LLP

[57] ABSTRACT

This invention relates to a lifting jack for automobiles and other vehicles. In particular, a one piece load rest is disclosed having a top surface with elements including a flat, a trough, and a ridge to connect to a vehicle, and having right and left legs to straddle and to fasten to a jack. The jack is characterized in that: the load rest is formed from a flat plate that in two dimensions has a first section with a first locking connector, a second section with the legs extending laterally outwardly, a third section outlining the elements of the top surface, and a fourth section with a second locking connector. The third section is bent to form the flat, trough, and ridge elements of the top surface. The legs of the second section are bent upwards, and the second section is bent under the top surface to project the legs downwardly. The first locking connector is joined to the second locking connector to secure the load rest together.

7 Claims, 5 Drawing Sheets

ONE PIECE LOAD REST

FIELD OF THE INVENTION

This invention relates to a lifting jack for automobiles and other vehicles. More particularly, it relates to an improvement in the construction of a load rest of a jack.

BACKGROUND OF THE INVENTION

A portable jack is usually stored in a vehicle, such as an automobile or truck, to enable a driver to lift the vehicle to effect emergency repairs, for example, to change a tire. One popular type of jack for automobiles is the pantograph jack. Known pantograph jacks typically have four arms hinged in a parallelogram at four joints. One joint is located on a base of the jack. Another joint is positioned at a load rest vertically above the base. Two other free floating joints are located on a horizontal diagonal at opposite corners of the parallelogram formed by the arms. When the free floating joints are drawn together in a horizontal plane the arms extend vertically to lift the load support with respect to the base and vice versa. The relative position of the free floating joints is controlled by a drive screw or threaded shaft which links them together.

Safety requirements require that a jack have the ability to lift, hold in an elevated position and lower a vehicle under a number of offsetting conditions. For example, a jack must have stability under longitudinal or lateral loading conditions which might occur when elevating an automobile on surfaces that may be inclined in any direction. While stability is ultimately determined by the overall construction of a jack, an important contribution to stability is made by the design of a load rest for it is the point at which the vehicle interfaces with the jack. The shape and dimensions of a load rest determine how the load rest will engage with a vehicle to secure it against slippage under various conditions. The shape must also accommodate quick and easy attachment to a vehicle by an unskilled operator with minimal instruction. A load rest should also interface with a vehicle to resist pitching, rolling or yawing movements of the vehicle that might upset the jack.

One example of a prior art load rest is found in U.S. Pat. No. 5,135,201 which discloses a two piece load rest in which a bracket connects to a lift cap with tabs that fit through slots therein. Other examples of prior art load rests are disclosed in U.S. Pat. Nos. 1,701,314, 4,194,725, 4,836,502, 4,848,733, 5,199,688; German patents Nos. 2,936,002 and 3,033,956 and U. K. patents 2,070,560 and 2,145,392.

It is known to construct a load rest having a top surface which includes a flat, a trough and a ridge in succession. This feature enables a user to locate a load rest under a vehicle by sliding it forward so that the flat slips under a depending flange and the ridge abuts against it. This aligns the trough under the edge of the flange so that it is located securely in the trough during lifting, holding and lowering.

It is an object of the present invention to disclose a one piece load rest having the flat, trough and ridge construction with an improved design that provides the advantage of one piece fabrication. This and other improvements in the design from the point of view of manufacturing costs and strength of the part will be apparent to the person skilled in the art having read this disclosure.

SUMMARY OF THE INVENTION

The one piece load rest of this invention is fabricated from a plate. The load rest has a top surface with a flat, a trough and a ridge; right and left legs with attachment means to connect to a jack has a locking means to secure its integrity after assembly.

This invention is particularly suited for use in a pantograph jack. As discussed above a pantograph jack typically comprises a base to support the jack on a lifting surface, a pantograph of four arms to provide lifting and lowering capability and a load rest to interface with a vehicle. The two lower pantograph arms are pivotally connected in the base and geared to one another to turn synchronously in opposite radial directions. The two upper pantograph arms are pivotally connected in a load rest and geared to one another to turn synchronously in opposite radial directions. Free floating joints connect the lower pantograph arms to the upper pantograph arms. A drive screw extending through and having a threaded connection with one such joint and bearing upon the other joint may be driven to control the distance between said joints which controls the shape and particularly the height of the pantograph.

The right and left legs of the load rest of this invention straddle the upper arms at the top of the pantograph. Each leg has connection means to connect to the upper pantograph arms to permit rotation of the arms in relation to each other and in relation to the load rest while maintaining the load rest in a horizontal orientation. For example, holes may be provided to receive pins that penetrate the arms and the load rest legs and act as axes of rotation for the arms. Other means will not be discussed as this connection is within the skill of the art.

The load rest of this invention is manufactured by first cutting a two dimensional outline of the load rest in a plate of steel, or other suitable material. The outline, beginning from one end of the plate, generally comprises: the right and left legs separated by a section between them; the flat, the trough and ridge (although flattened) and, at the second end of the plate, the locking means. The locking means may be at the first or the second end of the plate or both. The purpose of the locking means is to join the ends after assembly. In a preferred embodiment the locking means is a tab which folds over the other end of the plate.

The plate is bent in (or with) a tool to form the trough and the ridge of the top surface. The legs are folded up. The section of the plate between the legs and the legs are bent under the top surface to project the legs outwardly from the doubled over plate. The locking means joins the then adjacent first and second plate ends to complete the load rest. For example, a locking tab may be bent from one plate end to the other. In preferred embodiments a tab from one plate end would locate in a slot in the other plate end to impede lateral displacement of the ends under loading.

In preferred embodiments the section of the plate between the legs may be cut internally to provide an opening into which the trough can be located as the plate is doubled over which adds strength and further secures the integrity of the load rest. Further a slot may be cut into this section at the end of the plate to provide a slot to receive the locking tab. In other preferred embodiments outward protruding dimples may be formed in the legs to underlie the trough for additional support. This feature permits the top surface of the load rest to extend laterally outward beyond the lateral position of the legs to provide a wider interface with the vehicle which contributes to a more stable relationship between the load rest and the load.

DESCRIPTION OF THE FIGURES

In the figures which illustrate a preferred embodiment of this invention.

DESCRIPTION OF THE INVENTION

Figure 1:
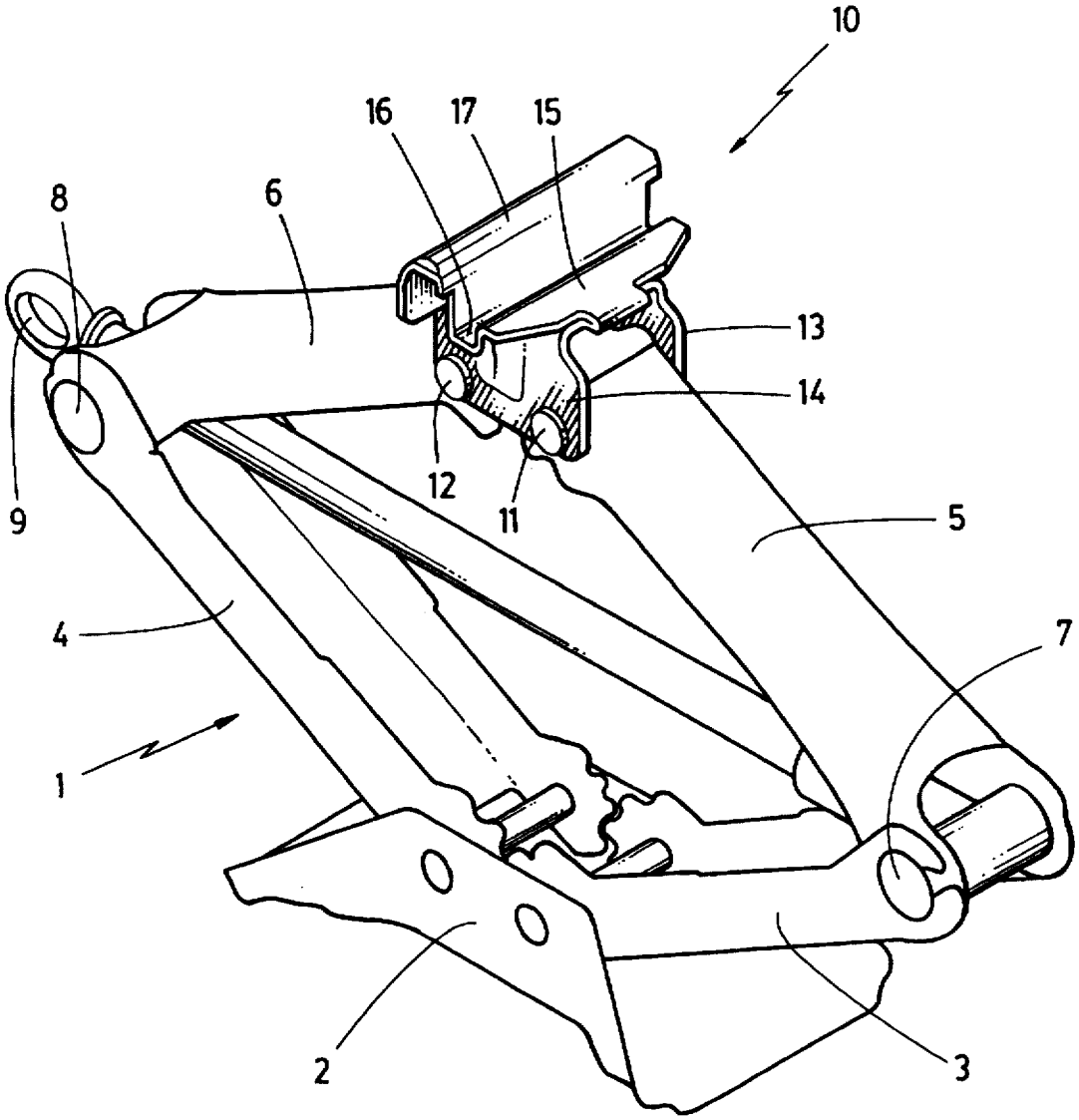
FIG. 1 is a perspective view of a typical pantograph jack having a load rest of this invention.

FIG. 1 illustrates a typical pantograph jack. A base 2 supports the jack on a lifting surface. A pantograph of four arms provides the lifting and lowering capability. Two lower pantograph arms 3 and 4 are pivotally connected in the base 2 and geared to one another to turn synchronously in opposite radial directions. Two upper pantograph arms 5 and 6 are pivotally connected in a load rest 10 and geared to one another to turn synchronously in opposite radial directions. Joints 7 and 8 connect the lower pantograph arms 3 and 4 to the upper pantograph arms 5 and 6, respectively. A drive screw 9 between joints 7 and 8 controls the distance between said joints and thereby the shape and height of the pantograph. A load rest 10 supports a load, for example a portion of an automobile or truck, during lifting. The load rest 10 is raised and lowered with respect to the base 2 by controlled operation of the drive screw 9 to deform the pantograph.

As illustrated in FIGS. 3–7, the load rest 10 generally comprises a right leg 13, a left leg 14, a top surface 15, a trough 16 and a ridge 17. Each leg has holes 34 to receive pins 11 and 12 to connect onto the upper pantograph arms 5 and 6. The top surface 15 is lower than the ridge 17. This feature facilitates location of the load rest 10 in relation to a depending flange of a vehicle (not shown) while the jack is slid under the vehicle in the lowered position. The top surface 15 slides under the flange and the ridge 17 abuts against the flange to align the trough 16 under the flange. Then as the jack is raised the flange is located securely in the trough 16.

Figure 2:
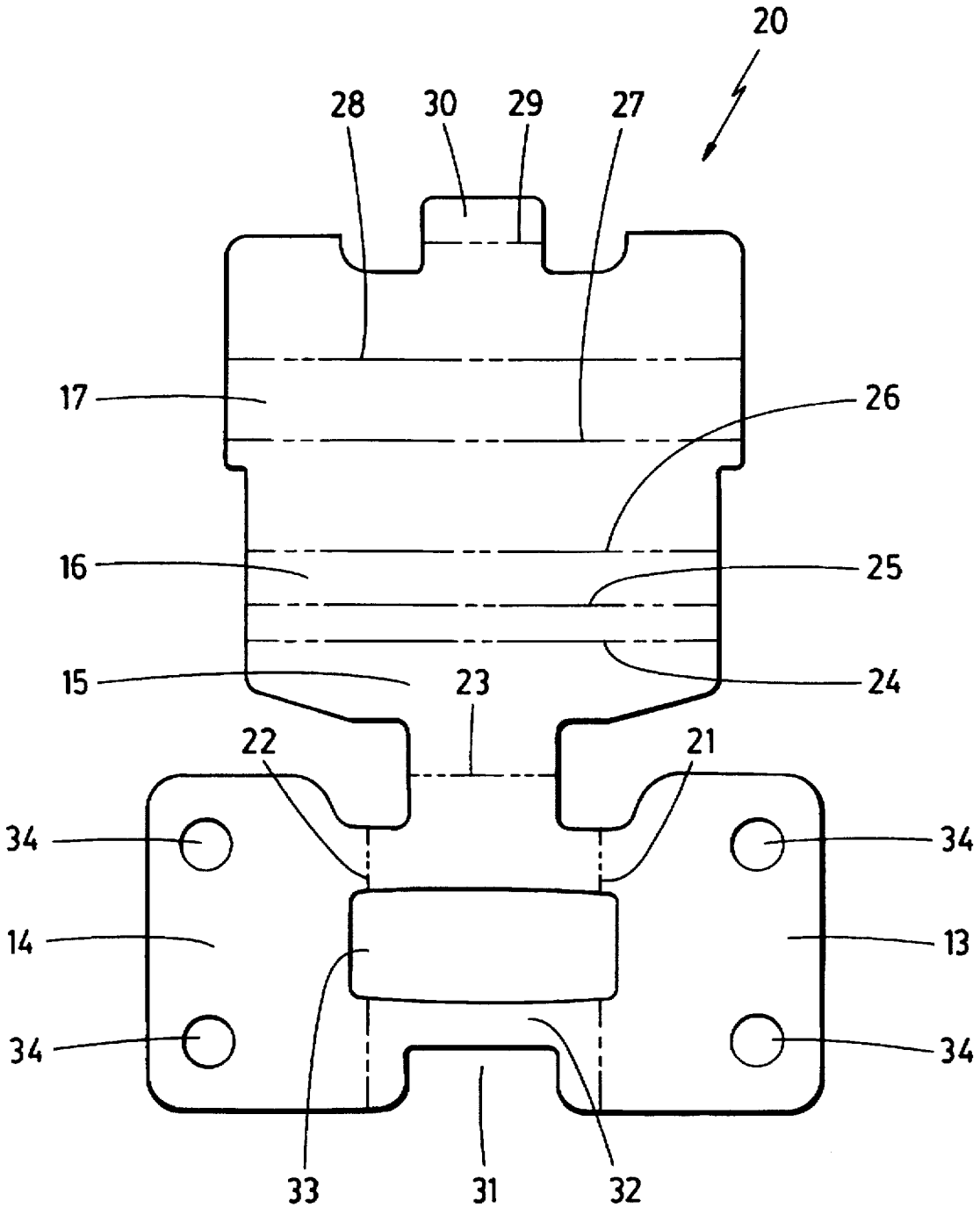
FIG. 2 is a plan view of a plate (with imaginary folding lines) used to fabricate the load rest of this invention.
Figure 3:
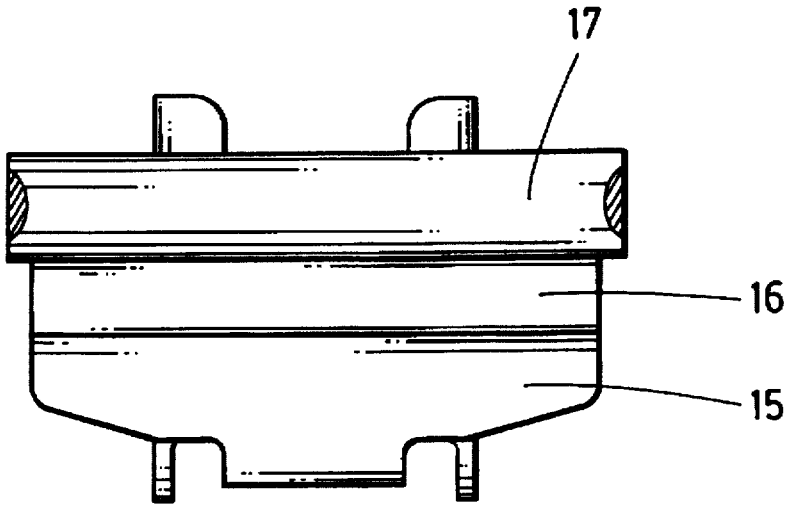
FIG. 3 is a top view of the preferred embodiment after folding.
Figure 4:
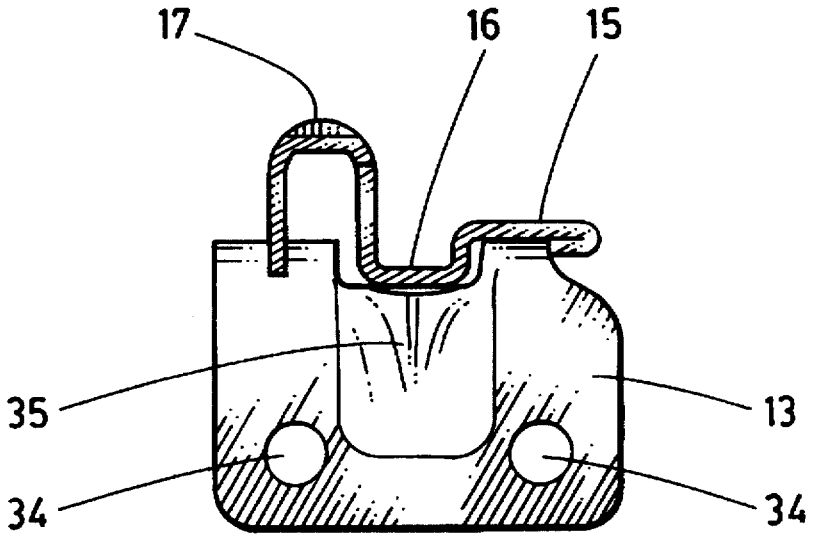
FIG. 4 is a side view the preferred embodiment after folding.
Figure 5:
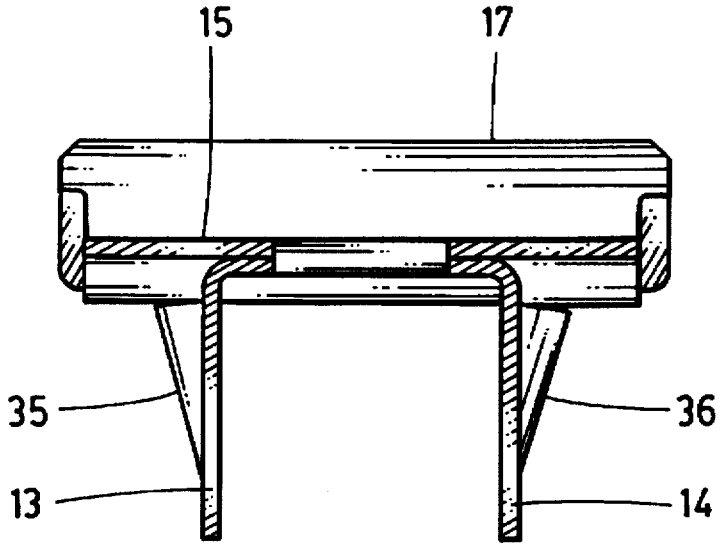
FIG. 5 is a front view the preferred embodiment after folding.

The load rest 10 is manufactured by bending a flat steel plate 20 that has been cut in the shape shown in FIG. 2. FIG. 2 shows a number of imaginary folding lines to indicate where the plate is bent during fabrication. Folding lines 21 and 22 delineate the legs 11 and 12, respectively and the section between them. The folding line 23 permits the leg assembly to be folded under the balance of the plate 20. The plate 20 is also bent at folding lines 24, 25 and 26 to form the trough 16 and then at folding lines 27 and 28, to form the ridge 17. It is also bent at folding line 29 to form a tab 30 which is folded into slot 31 and flange 32 as a last step to lock the folded construction into an integral unit. The section between the legs 11 and 12 has a rectangular opening 33 to receive the depending trough 16 which tends to further secure the folded parts together.

Figure 6:
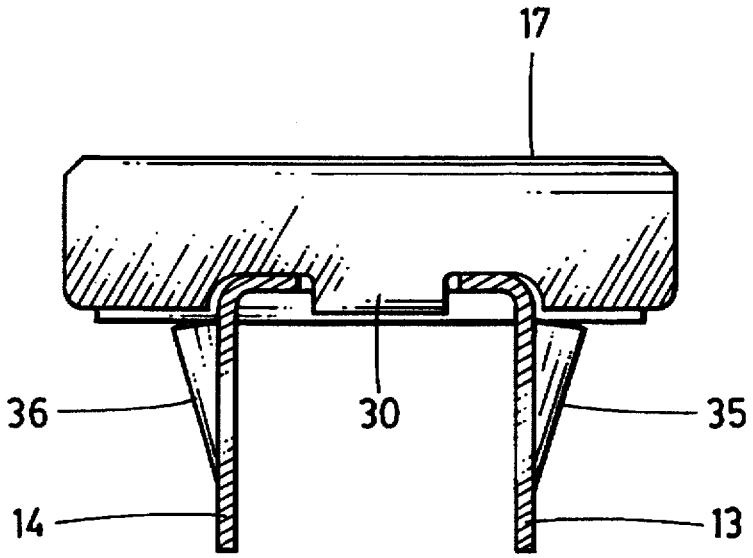
FIG. 6 is a rear view the preferred embodiment after folding.
Figure 7:
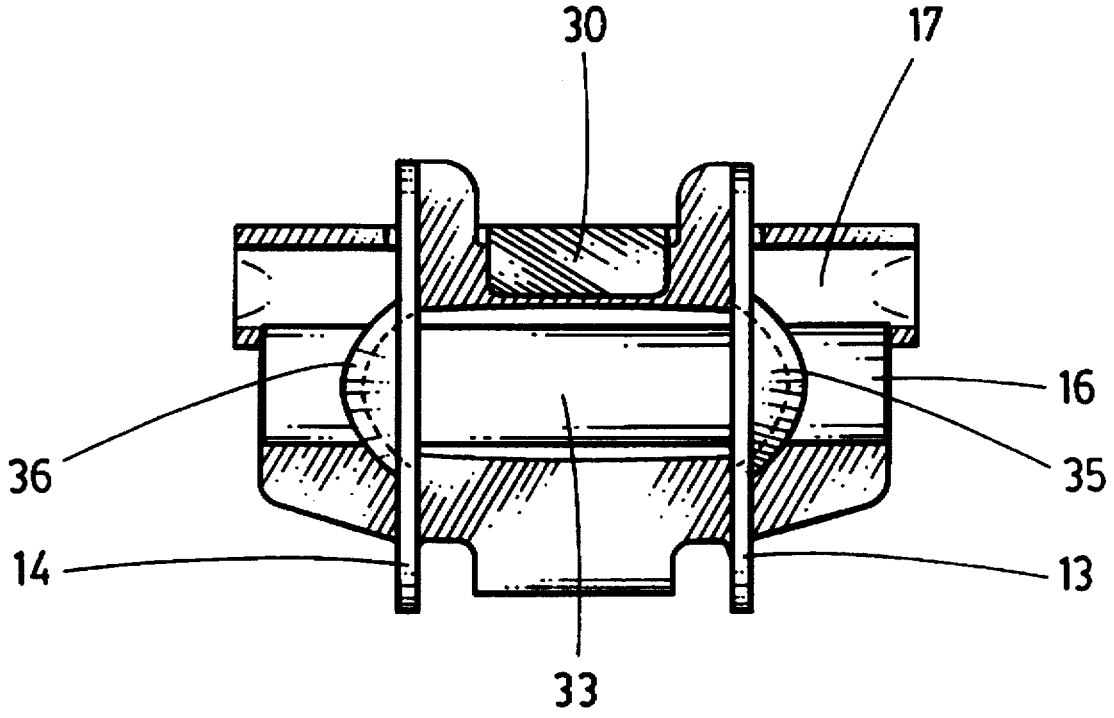
FIG. 7 is a bottom view the preferred embodiment after folding.

The process for manufacture of the load rest is as follows. The plate 20 is cut into a two dimensional shape generally shown in FIG. 2 including the locking tab 30, the slot 31, the rectangular opening 33, the legs 11 and 12, the trough 16, the ridge 17 and the connecting holes 34 for attaching a load rest to the upper arms 5 and 6 of the pantograph jack. It will be appreciated by skilled persons that the plate 20 may folded differently than as next described depending upon the tools employed. It is preferred that the ridge 17 be formed first by folding the plate downwardly at folding lines 27 and 28; next the trough 16 is formed by folding upwardly at successive right angled folds on lines 25 and 26 and then downwardly at right angles at line 24 to form the flat potion 15. The dimples 35 and 36 are formed downwardly at opposite lateral ends of rectangular opening 33 and legs 11 and 12 are bent upwardly at folding lines 21 and 22, respectively. (The dimples are best shown in FIGS. 4, 5, 6 and 7). Next, the leg assembly is folded downwardly at folding line 23 under the trough 16 to fit rectangular opening 33 about the trough 16 and to permit the dimples 35 and 36 to abut it to provide additional support to the laterally projecting ends of the trough 16. Finally, the tab 30 is connected into slot 31 under flange 32 as illustrated in FIGS. 6 and 7.

The foregoing description of the preferred embodiments of this invention is directed to one skilled in the art and is explanatory rather than limiting of the features of this invention and its manufacture. Equivalents and substitutions that are obvious to skilled persons reading this specification in view of the prior art are intended to be included for all parts described. Dimensions and shapes of the parts shown in the drawings are not essential and may be adapted in accordance with usual engineering practice as is appropriate to particular end uses. Obviously unsuitable materials and dimensions are intended to be excluded.

What we claim is:

1. A one piece load rest having a top surface with elements including a flat portion, a trough portion and a ridge portion to connect to a vehicle and having right and left legs to straddle and to fasten to a jack, wherein: the load rest is formed from a flat that in two dimensions has a longitudinal axis and, in the order recited from one longitudinal end thereof to the other, a first section with a first locking connector portion, a second section with the legs extending laterally outwardly, a third section for defining the elements of the top surface, and a fourth section with a second locking connector portion; said flat plate being bent so that said third section is bent to form the flat portion, trough portion and ridge portion of the top surface, the legs of the second section are bent upwards and the second section is bent under the top surface to define a two layer structure and to project the legs downwardly; and said first locking connector portion being joined to said second locking connector portion to secure the bent flat plate together.

2. The load rest of claim 1 in which the jack is a pantograph jack and each right and left leg has connection structure to connect onto a pair of upper arms of the pantograph to permit rotation of the upper arms in relation to one another and the legs while maintaining the flat portion in a horizontal orientation.

3. A one piece load rest having a top surface that includes a flat portion, a trough portion and a ridge portion; and having right and left legs to straddle and to fasten to a pantograph jack in rotatable connection, wherein the load rest is formed from a flat plate originally shaped to outline in two dimensions, in the order recited from a first longitudinal end, a first section, right and left legs extending laterally outwardly from the first section, the first section having a centrally located rectangular opening to receive the trough portion; followed next by a flat segment, a trough segment and a ridge segment for defining, respectively, said portions of the top surface and a locking tab at a second longitudinal end of the plate, said plate having been bent to form in three dimensions the flat portion, trough portion and ridge portion of the top surface, bent to fold the legs up and bent to fold the legs and the section between the legs under the top surface to define a doubled over plate and to project the legs downwardly from the doubled over plate and to locate the trough in the rectangular opening in said first section and bent to secure the locking tab to said first longitudinal end to secure the plate ends together.

4. The load rest of claim 3, in which each of the right and left legs of the flat plate is dimpled downwardly adjacent the centrally located rectangular opening in the said first section so as to project laterally outward under the trough portion when the plate is bent and the trough portion is inserted into said opening.

5. A one piece load rest having a top surface that includes a flat portion, a trough portion and a ridge portion; and right and left legs to straddle and to fasten to a pantograph jack in a rotatable connection, wherein the load rest is formed from a flat plate originally shaped to outline in two dimensions so that the right and left legs extending laterally outward, a section between the legs having a width W and having a centrally located opening to receive the trough portion; followed next in a longitudinal direction of the flat plate by a flat segment, a trough segment and a ridge segment for defining, respectively, said portions of the top surface, and each having a width wider than W, and a locking tab on one end of the flat plate;

each of the right and left legs of the flat plate is dimpled downwardly adjacent the centrally located opening in said section;

said plate having been bent to form in three dimensions the flat portion, trough portion and ridge portion of the top surface, bent to fold the legs up and to fold the legs and the section between the legs under the top surface to define a doubled plate structure and to project the legs downwardly from the doubled plate, to insert the trough portion in the opening in said section and to project the dimples laterally outward under the trough, and bent to fold the locking tab on said one flat plate end into a slot in a second plate end to secure the plate ends together and to impede lateral displacement thereof under loading.

6. The one piece load rest of claim 1, wherein said first locking connector comprises a tab and said second locking connector comprises a slot and said locking connector is joined to said second locking connector by inserting said tab in said slot and bending said tab.

7. The one piece load rest of claim 1, wherein said third section has a width after bending that is substantially wider than a width of said second section after bending.

* * * * *